United States Patent [19]

Cooper

[11] 4,263,797

[45] Apr. 28, 1981

[54] METHOD OF RECLAIMING USED RAILROAD SPIKES

[76] Inventor: Roger H. Cooper, 7325 Interlochen Dr., Nixa, Mo. 65714

[21] Appl. No.: 5,811

[22] Filed: Jan. 23, 1979

[51] Int. Cl.[3] ..... B21K 9/00; B21D 3/10

[52] U.S. Cl. ..... 72/40; 29/402.19; 29/403.1; 104/1 R

[58] Field of Search ..... 29/402.1, 402.19, 403.1, 29/403.3, 407; 51/163.1, 164.1, 313; 72/40; 104/1 R, 2, 17 R; 105/1 R, 1 A

[56] References Cited

U.S. PATENT DOCUMENTS

| | | | |
|---|---|---|---|
| 2,635,473 | 4/1953 | Rampe | 51/164.1 |
| 2,809,473 | 10/1957 | Heaphy | 51/164.1 |
| 3,604,241 | 9/1971 | Blix | 72/416 |
| 3,731,455 | 5/1973 | Theurer | 104/1 R X |
| 4,178,236 | 12/1979 | Theurer | 104/1 R X |
| 4,178,237 | 12/1979 | Theurer | 104/1 R X |

*Primary Examiner*—Ervin M. Combs
*Attorney, Agent, or Firm*—William E. Mouzavires

[57] ABSTRACT

A method of reclaiming railroad spikes is disclosed in which the used spikes are collected and initially manually sorted to separate the bent and straight reclaimable spikes and to eliminate those damaged beyond reclaiming. The bent spikes are placed in a press and straightened, then the straight and straightened spikes are dumped into a sound insulated, sealed drum type tumbler and tumbled until clean and ready for reuse. The straightening press, tumbler, and a hoist for handling portable bins of spikes are mounted on a car moveable over railroad tracks and movement is controlled either by an operator who walks along the right of way collecting and sorting previously pulled spikes or the operator on the machine. The car is provided with a platform at its rear end for supporting the portable bins.

6 Claims, 9 Drawing Figures

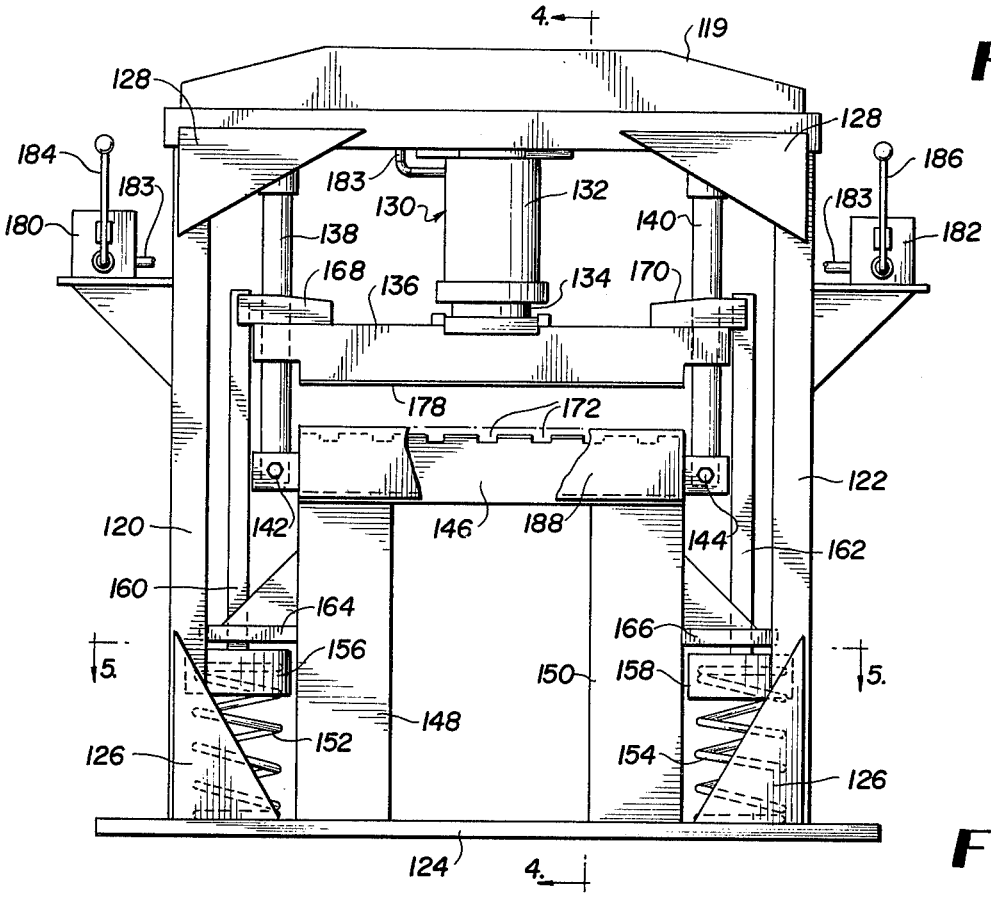
FIG. 3
FIG. 4
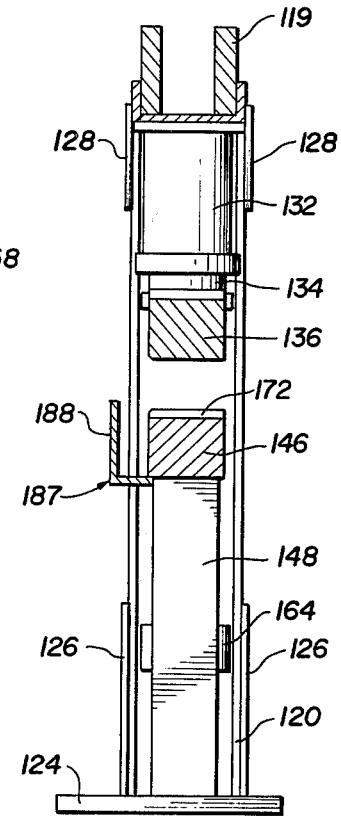
FIG. 5
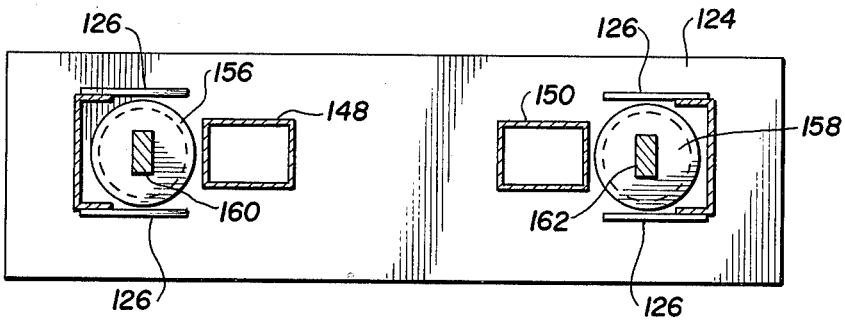
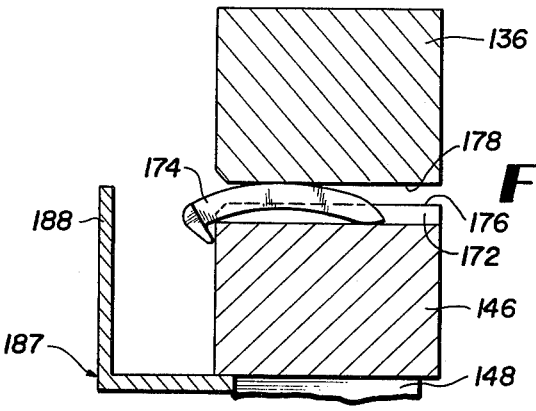
FIG. 6

FIG. 7
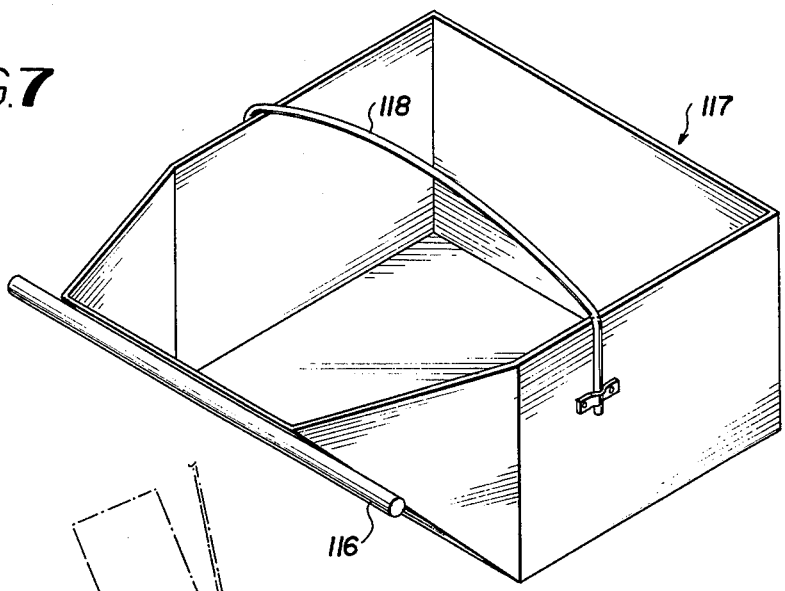
FIG. 8
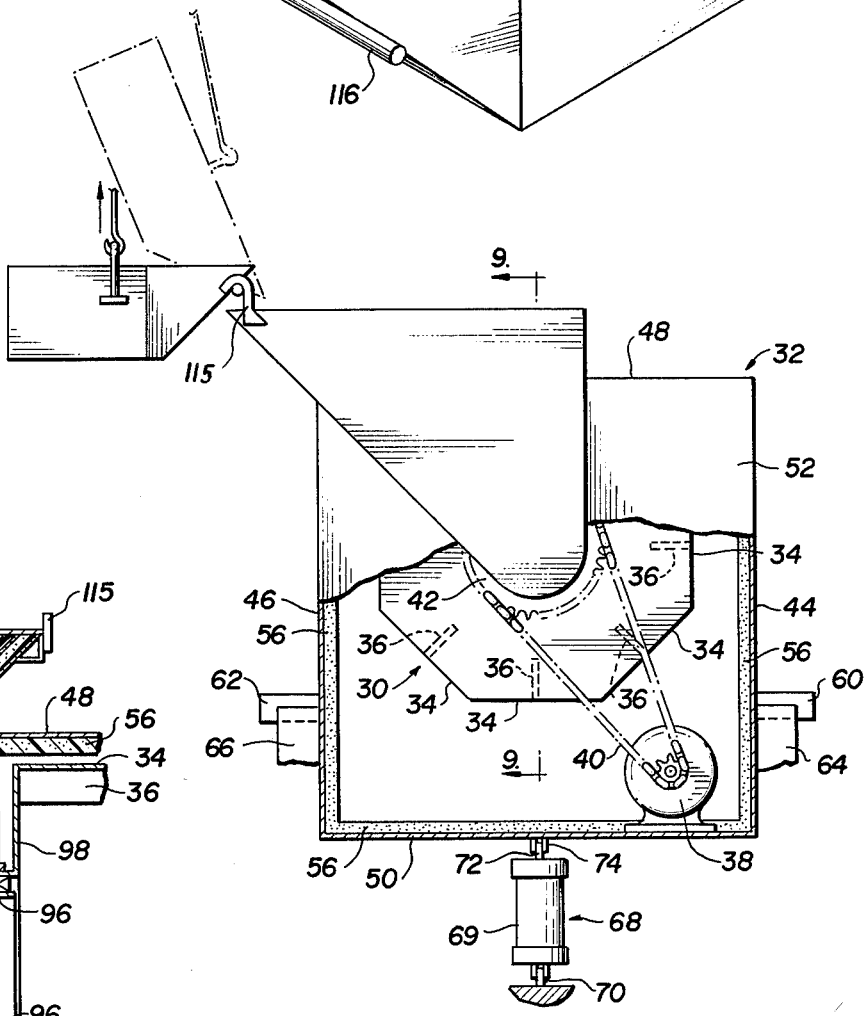
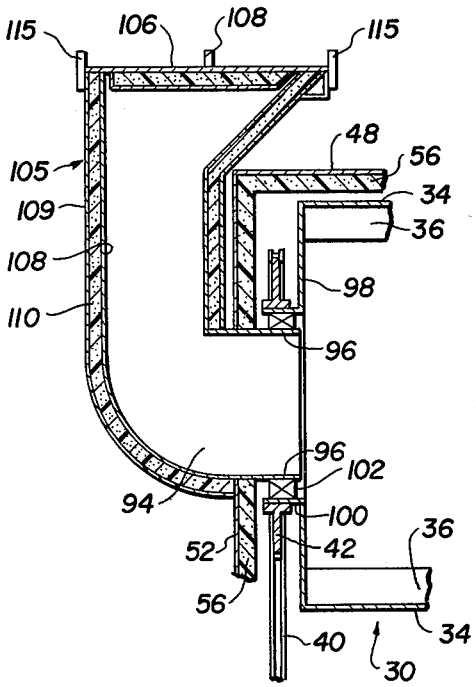
FIG. 9

METHOD OF RECLAIMING USED RAILROAD SPIKES

BACKGROUND OF THE INVENTION

1. Field of the Invention

This invention relates to the reclaiming of used railroad spikes, and to an improved high speed, highly efficient method of and apparatus for reclaiming used railraod spikes by straightening and/or tumble cleaning the used spikes.

2. Description of the Prior Art

The reclaiming of used railroad spikes has, in the past, generally been limited to a manual operation employing a driven wire brush wheel or similar abrading tool to clean the spikes which were hand held during the cleaning operation. Spikes which were not too severely bent were sometimes straightened, again one at a time, by an impacting or pressing operation. Such manual reclaiming methods are very slow and hazardous to the operator. As a result, it generally has not been considered economically feasible to reclaim used railroad spikes and it has become common practice to discard the used spikes along the railroad right of way as they are pulled, or to collect them only for scrap value. As a result, power equipment currently used to pull spikes normally does not collect or save the spikes, but rather discards them onto the roadbed as they are pulled. Many millions of dollars worth of spikes are currently being scrapped or discarded annually in the United States alone.

In recent years, the cost of new railroad spikes has increased dramatically, making them an increasingly important element in the cost of track reconstruction and maintenance. Despite this, the increasing labor costs of the prior art manual reclaiming processes have been such that the used spikes have continued to be discarded. One factor in this has been the labor requirement and expense of collecting the used spikes and returning them to a central shop location for manual reclaiming before being returned to the steel or tie gang for use.

In view of the foregoing, it is a primary object of the present invention to provide an improved process of and apparatus for the high speed, efficient reclaiming of used railroad spikes.

Another object of the invention is to provide such a method and apparatus whereby used railraod spikes may be reclaimed and reused at the job site.

Another object of the invention is to provide such a method and apparatus which provides an increased salvage rate.

Another object of the invention is to provide such a method and apparatus which is substantially free of personnel hazards.

SUMMARY OF THE INVENTION

The foregoing and other objects and advantages are achieved in accordance with the present invention wherein used spikes collected along the railroad right of way are manually sorted to eliminate those damaged beyond economical reclaiming and to segregate the straight and bent reclaimable spikes. As the spikes are sorted, they are deposited in hoppers carried on a platform of a mobile reclaiming car moveable along the railroad tracks.

The reclaiming car is equiped with a driven, sound insulated tumbler for cleaning the spikes, a press for straightening bent spikes, a hoist for handling the bins of spikes to move them, as required, on the car, and power means for operating the equipment and for propelling the car along the railroad tracks. A first operator's station is provided at the straightening press, enabling the press operator to control operation of the reclaiming apparatus and, when necessary, movement of the car along the tracks. A second operator's station, having duplicate controls for the car's propulsion system, is located at one end of the car in position to be readily accessible by a person walking along the roadbed. This enables the movement of the car to be controlled by laborers picking up and sorting the pulled spikes with the sorted spikes being collected in the portable bins or receptacles carried on the car.

An operator riding the car can operate the press to straighten the reclaimable bent spikes as the car moves along the tracks. The operator can also control the hoist to pick up and move a bin of spikes as necessary to load the tumbler, or to remove a keg of cleaned spikes dumped from the tumbler. The hoist can also be used to move a bin of spikes to a convenient position adjacent the press for ready access by the operator. Spikes reclaimed on such apparatus can be reused immediately by a steel or tie gang, thereby substantially simplifying the logistics involved in maintaining a supply of spikes on the job.

BRIEF DESCRIPTION OF THE DRAWINGS

Other objects, features and advantages of the invention will become apparent from the detailed description contained hereinbelow, taken in conjunction with the drawings, in which:

FIG. 3 is an elevation view, with certain parts partially broken away, of a spike straightening press employed in the apparatus of FIGS. 1 and 2;

FIG. 4 is a sectional view taken on line 4—4 of FIG. 3;

FIG. 5 is a sectional view taken on line 5—5 of FIG. 3;

FIG. 6 is an enlarged fragmentary sectional view showing a railroad spike being straightened in the press of FIGS. 1 through 5;

FIG. 7 is a perspective view of a portable spike bin employed for collecting and handling used spikes;

FIG. 8 is an end elevation view of the tumble cleaner used on the spike reclaiming apparatus shown in FIGS. 1 and 2; and FIG. 9 is a fragmentary sectional view taken on line 9—9 of FIG. 8.

DESCRIPTION OF THE PREFERRED EMBODIMENT

Figure 1:
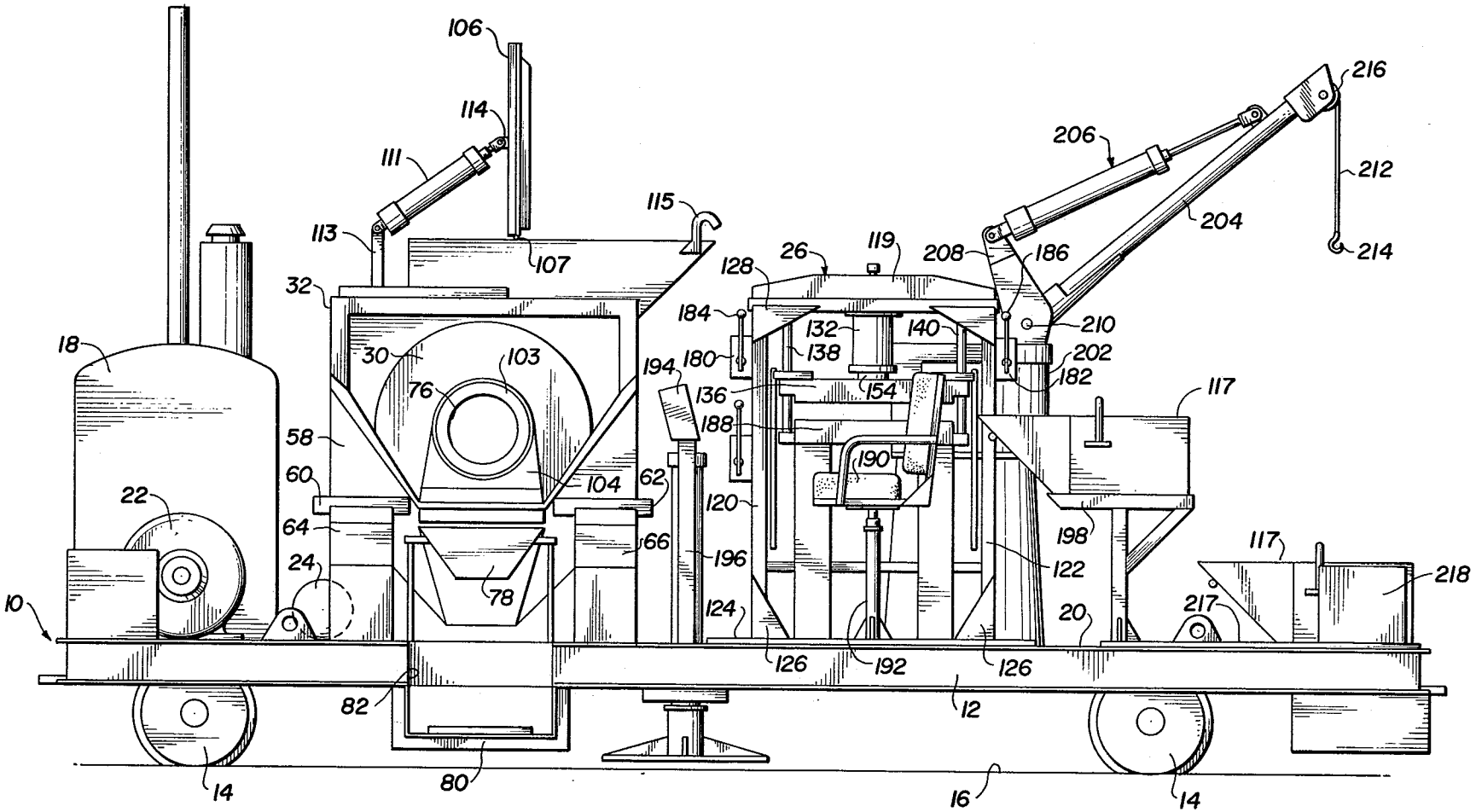
FIG. 1 is a side elevation view, with certain parts omitted to more clearly illustrate other parts, of a spike reclaiming apparatus according to the invention.
Figure 2:
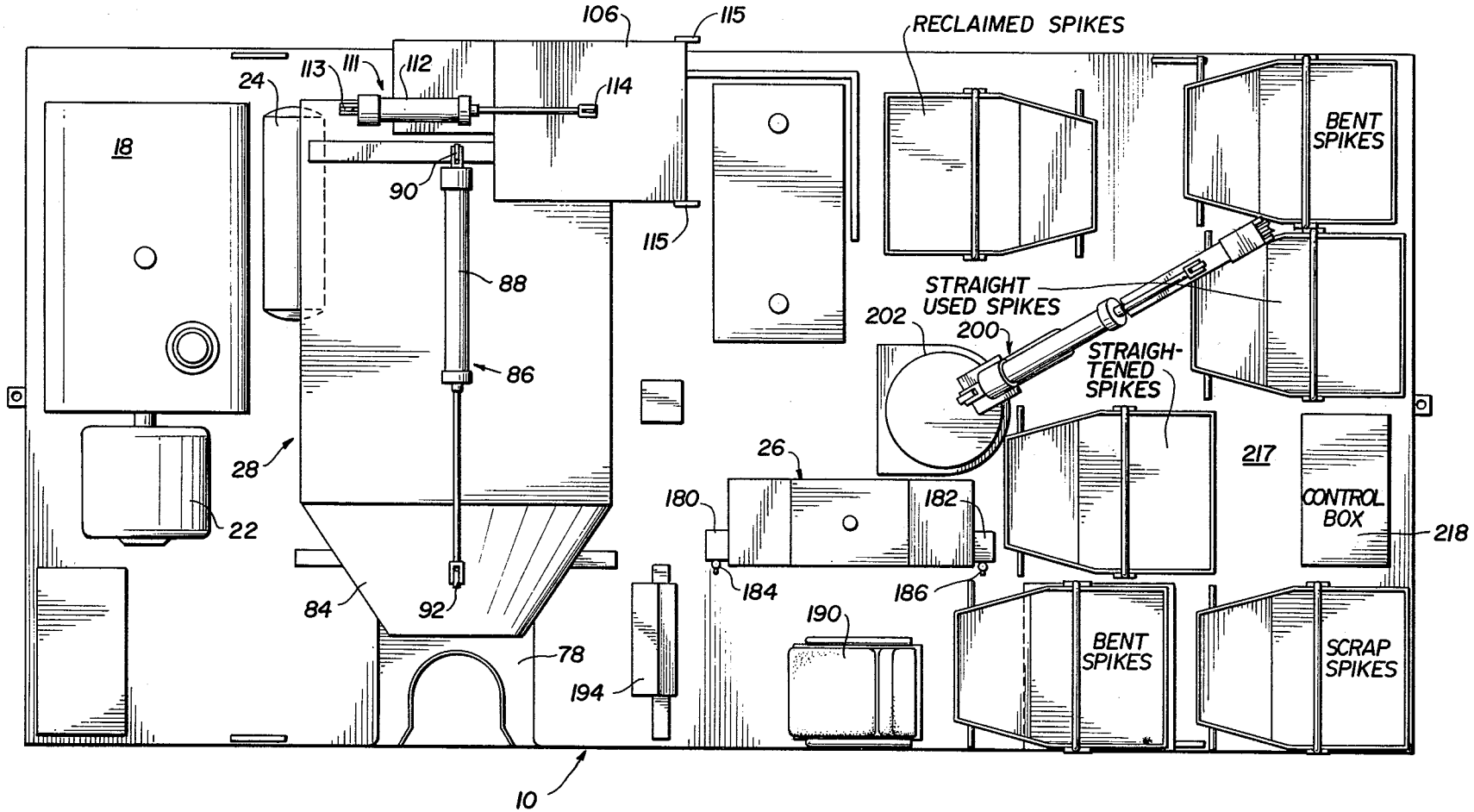
FIG. 2 is a top plan view of the apparatus shown in FIG. 1.

Referring now to the drawings in detail, railroad spike reclaiming apparatus according to the present invention includes a reclaiming car 10 having a frame 12 supported on flanged wheels 14 for movement along standard railroad tracks 16. Suitable drive means such as an internal combustion engine 18 is provided on the forward end of the reclaiming car and is supported directly on the substantially flat floor surface 20. Engine 18 also drives suitable auxiliary power equipment such as a generator 22, an air compressor (not shown) for supplying compressed air to the storage tank 24 and a hydraulic pump (also not shown) for actuating various powered components of the apparatus.

A spike straightening press 26 used in straightening bent spikes, and a rotary tumble cleaner 28 are mounted on the reclaiming car rearwardly from the engine 18. The tumble cleaner 28 extends transversly of the car and, as best seen in FIGS. 8 and 9, comprises a cleaning drum 30 mounted for rotation about a substantially horizontal axis within a generally rectangular housing 32. Drum 30 is made up of a plurality of substantially flat, straight side wall sections 34, giving the drum a substantially octagonal configuration in vertical transverse cross-section. Each flat wall section 34 has rigidly welded on its inner surface a longitudinally extending baffle 36 which promotes the tumbling of spikes in the rotating drum to facilitate cleaning. A suitable drive motor 38 mounted within the housing 32 drives drum 30 through a drive chain 40 extending around a sprocket 42 mounted on the end of the drum.

Housing 32 has substantially vertically extending, opposed side walls 44, 46, a substantially horizontal top and bottom walls 48, 50, respectively, and a rigidly attached vertical rear end wall 52. A layer of resilient sound insulation material 56 extends over the inner surface of the housing to provide sound insulation for the tumble cleaner. Insulation material 56 may be a foamed rubber-like material adhesively bonded directly to the inner surface of the walls of the housing or, alternatively, the housing may be of a double wall construction with the insulation material filling the space between the double walls.

The forward, or discharge end of the housing 32 is in the general configuration of a frustum of a pyramid and is formed in two sections including a bottom section 58 rigidly joined as by welding to the side walls 44, 46 and bottom walls 50. A pair of stub shafts 60, 62 are rigidly mounted on and project laterally outward from the pyramid section 58, with the stub shafts being mounted in brackets 64, 66, respectively, for supporting the forward end of the housing for pivotal movement about a horizontal, longitudinally extending axis. The rear end of the housing is supported by a generally vertically extending hydraulic ram 68 which has its cylinder 69 pivotally connected through bracket 70 to the frame of car 10, and its piston 72 pivotally connected, through bracket 74, to the bottom of housing 32. Thus, by actuation of ram 68 to extend piston 72, housing 32 and drum 30 will be pivoted about the axis of shafts 60, 62 to elevate the rear end of the drum above the open outlet 76 (FIG. 1) of the drum to discharge spikes onto a guide chute 78. Chute 78 directs the cleaned spikes to a storage keg, not shown, positioned on a spike keg support bracket 80 mounted on frame 12 below a cutout 82 in the frame and in floor 20.

Before tilting the tumble cleaner to the discharge position, top section 84 of the pyramid shaped forward end of housing 32 is pivoted to an open position by hydraulic ram 86 having its cylinder 88 pivotally connected, through bracket 90, to the frame 32 and its piston connected through bracket 92, to the member 84. In FIG. 1, member 84 and actuating ram 86 are removed to more clearly illustrate other parts. Also, both the upper and lower segments of the pyramidal end portion of housing 32 have their inner surface coated with the layer 56 of sound insulating material.

As shown in FIG. 9, rear wall 52 has an opening 94 formed therein, and a cylindrical sleeve 96 rigidly welded to the rear wall projects inwardly into the housing. The rear wall 78 of drum 30 is provided with a circular opening and an annular flange 100 extends rearwardly from the opening in the wall 98 in outwardly spaced concentric relation to the inner end of sleeve 96. An anti-friction bearing assembly 102 positioned between the flange 100 and sleeve 96 supports the rear end of the drum 30 for rotation about its horizontal axis. A similar bearing 103 (FIG. 1) supported by a bracket 104 mounts the forward end of drum 30.

Rigidly mounted on and projecting upwardly from the outer end of sleeve 96 at the rear end of housing 32 is a loading chute 105 having a sound insulated cover 106 mounted, as by hinge 107 on its top end for closing the chute. The walls of chute 105 are of double construction, including spaced metal inner and outer panels 108, 109, and an inner layer of sound insulating material 110. Door 106 is moved between an open and closed position by a fluid ram 111 having its cylinder end pivotally connected to a bracket 113 and its piston end pivotally connected through a bracket 114 to the top portion of the door. A pair of hooks 115 are mounted one on each side of the chute 105 adjacent the side edges of door 106 in position to engage a trip bar 116 on a portable spike bin, or receptacle, 117 to tilt the bin, when supported by a suitable sling, or bail 118, to dump the contents of the bin into the guide chute in the manner described more fully herein below.

Referring now to FIGS. 1–6, the spike straightening press at 26 is mounted upon and rigidly bolted to floor 20 at a position spaced rearwardly from tumbler 28, and offset to one side of the longitudinal center line of car 10. Press 26 is made up of an A-frame assembly including a crosshead, or beam 119, having its opposed ends supported on columns 120, 122, in the form of structural steel channels each having their bottom end rigidly welded to a base plate 124 and reinforced by a gusset plate 126. Similar gussets 128 are rigidly welded between the top of the columns 120, 122 and the crosshead 119.

A high-capacity hydraulic ram, 130 has its cylinder 132 supported on the underside of crosshead 119 midway between the columns 120, 122. The piston 134 of ram 130 extends downwardly and bears against an upper die member 136. A pair of guide rods 138, 140 are mounted on and extend downwardly from crosshead 119, one on each side of the ram 130, with guide rods 138, 140 having their lower ends connected, as by bolts 142, 144, to the ends of a lower die member 146. Upper and lower dies 136, 146, respectively, are rigid, elongated members, extending transversely of the press, with their ends spaced inwardly from the columns 120, 122. Upper die 136 is formed with a circular opening in its opposed ends, which receive and slide upon the guide rods 138 to 140 to guide the die between a raised position shown in FIG. 3 and a lowered position. Lower die 146 is supported by a pair of vertical columns, 148, 150, extending upward from a base plate 124 to provide a rigid support capable of withstanding the force of the hydraulic ram 130, pressing downward thereon through upper die 136.

Upper die 136 is normally spring biased to its upper or raised position by a pair of heavy coil springs 152, 154 each resting upon the base plate 124, one adjacent each of the columns 120, 122. The upper end of springs 152, 153 are positioned within downwardly open retainer or bearing cups 156, 158, which, in turn, are rigidly attached, as by welding to vertically extending bar members 160, 162. Bars 160, 162 extend through guide brackets 164, 166, respectively, rigidly mounted on and projecting outwardly from the columns 148, 150, respectively, to restrain and guide the bars 160, 162, for movement in a vertical line under the influence of springs 152, 154, and the ram 130. An inwardly directed arm, 168, is rigidly mounted on the top of bar 160 and extends over and is rigidly attached to the top surface of upper die 136, and a similar arm 170 attached to the top of bar 162 extends inwardly over and is rigidly attached to the opposite end of upper die 136. Thus, bars 160, 162 are constrained to move with the upper die 136 to compress springs 152, 154, when ram 130 is actuated to press the upper die member 136 downwardly into engagement with the lower die member 146. When hydraulic pressure is released from cylinder 132, springs 152, 154 acting through arms 160, 162, will return upper die 136, and piston 134, to the raised position shown in FIG. 3.

As best seen in FIGS. 3 and 6, lower die 146 has a plurality of transversely extending grooves 172, formed in its top surface, with the depth of the grooves 172 being slightly less than the thickness of a standard railraod spike. Grooves 172 have substantially flat bottom surfaces and vertical sides, with the grooves having a width, measured longitudinally of the elongated die 146, which is slightly greater than the thickness of a spike, and a length which is at least slightly greater than the length of a railraod spike.

As shown in FIG. 6, a bent spike 174 can be placed in a groove 172, which the head of the spike extending over the forward edge of the die member and with the body of the spike projecting upwardly slightly above the top surface 176 of lower die 146. Once a spike is placed in a groove 172 as described, it will remain stationary, resting upon one flattened surface of the spike, even though the body of the spike has been substantially bent. In this regard, it is pointed out that the body of the conventional railroad spike is substantially square or rectangular, and that spikes, when bent, will normally be bent principally towards one of the generally flat faces of the spike body. To straighten a spike on the press, the bent spike is placed in a groove 172 so that its principal curvature causes the body of the spike intermediate its ends to project upwardly from the supporting surface of the groove 172 and above the top surface 176 of lower die 146. However, because grooves 172 are slightly wider than the spike, some limited amount of bending towards a side face of the spike, as viewed in FIG. 6, can also be accommodated. In case of the spike being bent in a direction other than directly towards one rectangular face, two pressing actions of the apparatus will be required to completely straighten the spike. In this case, after integrally pressing the spike to straighten it in one direction as just described, the spike is manually rotated through 90° and again pressed to completely straighten the spike. It is important that the width and depth of the grooves 172 be such as to retain the spikes against turning.

A number of bent railraod spikes can be straightened in the press just described by manually placing a bent spike in each of the grooves at 172. Ram 130 is actuated, after the spikes are positioned in the grooves 172, to force the flat bottom surface 178 of upper die 136 downwardly against the top surface of the spikes 174, with sufficient force to completely straighten the spikes in one direction.

Two normally closed hydraulic fluid valves, 180, 182 mounted one on each side of press 26, are connected in series in a pressure fluid conduit 183 which, in turn, is connected to the ram 130, with the manual actuating levers 184, 186, of the respective valves being located a distance apart which requires the operator to use both hands to simultaneously actuate the valves. Since the valves are connected in series, both must be opened to actuate ram 130, thereby eliminating the possibility of accidental operation of the press when the operator has a hand between the two dies 136, 146. Also, a rigid structural angle 187 is mounted on the lower die member 146, with one leg 188 of the structural angle extending upwardly in outwardly spaced relation to and slightly above the front vertical face of lower die 146 to form a guard plate to protect the operator in the event of a head breaking from a spike and being propelled outwardly by the force of the press during straightening.

An operator's chair, 190, is mounted at an operator's station in front of press 26. A swivel base 192, rigidly fixed to the floor 20 of car 10 supports chair 190. From this chair 190, an operator can readily reach the lower die 146 to manually orient and place bent spikes in the grooves at 172 and, when the grooves in the die are loaded, to actuate valve levers 184, 186. Also, by swivelling the chair through 90° to face the forward direction of car 10, the operator has ready access to a control console 194 supported on a post 196 to control the actuation of the various components of the apparatus from one central location.

Immediately behind the operator's chair is a rigid pedestal 198 for receiving and supporting a bin 117, of bent spikes to be straightened on the apparatus. With a supply of bent spikes in position on platform 198, a operator sitting in chair 190 can readily reach into the bin with one hand and remove the bent spikes, two or more at a time, then using both hands quickly place one spike into each of the grooves 172. As the spikes are positioned in the press they are oriented with the maximum bend in a vertical plane as described above. Once straightened, the spikes, 174, can be quickly gathered by the operator and tossed into a second hopper, 80, setting on floor 20, at the rear edge of press 26. Any spikes requiring straightening in the second direction can be rotated through 90° and left in the press for the next pressing operation.

To handle the spike bins 117, an electric-hydraulic hoist 200 is mounted on a vertical support column 202 for rotation about the vertical axis of the support column. Hoist 200 includes a rigid boom 294, having one end pivoted about a horizontal axis on the top of the column, 202. A hydraulic ram 206, connected between a bracket 208 and boom 204, controls the vertical angle of the boom about its horizontal pivot axis at 210. A lifting cable 212, having a hook 214 on the free end thereof, extends over a pulley 216 at the free end of boom 204. An electric motor means, not shown, is contained within the support column 202 for rotating the hoist about its vertical axis and to actuate a winch, also not shown, to raise and lower the hook 214.

An operator, seated in chair 190, controls operation of the hoist by manipulation of suitable controls on panel 194. The length of boom 204 and of lifting cable 212 are such that, by varying the vertical angle of the boom, hook 214 can engage a lifting bail 118 on the bins 117 to move the bins over the car to any position desired for operation of the apparatus. For example, a hopper of straight spikes may be lifted from the substantially flat platform 217 at the back of the car 10 and, after actuation of the ram 111 to lift the loading chute cover 106, hoist 200 can be rotated and the bin lifted to engage the outwardly projecting ends of the trip bar 116 in the hooks 115. Cable 112 is then further retracted to lift and tilt the bin to the phantom line position illustrated in FIG. 8, to dump spikes from the bin through chute 105 into the tumbler drum 30. The empty bin may then be lowered from engagement with the hooks 115 and swung around and positioned on the bracket 80 to receive the cleaned spikes after being tumbled and reclaimed in the tumbler 28 or alternatively the bin can be returned to the rear platform section of floor 20 to receive more spikes. The hoist can be operated to lift a bin of bent spikes from the back of the car and place it on the pedestal adjacent the operator's seat or, to load or unload articles such as kegs of reclaimed spikes.

An auxiliary control box 218 is located at the back of car 10 in position to be readily accessible by a person walking along the right of way behind the car. Control box 218 has duplicate controls for controlling the propulsion of the car 10 along the tracks 16. Thus, when the spikes are being collected from along the right of way, movement of the car can be controlled by the person picking up the spikes. Control of the remaining functions can still be maintained from panel 194 without interfering with the movement of the car. Control of movement of the car does not in any way interfere with operation of the remaining apparatus by an operator in chair 190.

In operation of the reclaiming apparatus, according to the present invention, the car 10 will typically be placed upon the railroad tracks for movement therealong either in a steel gang laying new track or a tie renewal gang along an existing roadway. Once operation of the apparatus is commenced, control of movement of the car along the track is switched to the control panel 218 at the rear of the car, and one or more persons walking along the roadway at the rear of the car 10, picks up the used spikes which have been pulled and discarded by automatic spike pulling equipment used by the steel or tie renewal gang. As the used spikes are picked up, they are manually sorted and tossed into bins 117 positioned on the platform 217 along the back of the car, with the spikes which are damaged beyond economical reclaiming being deposited in a first or scrap bin, the bent but reclaimable spikes in a second bin, and the straight reclaimable spikes in a third bin. When sufficient spikes have been collected, an operator seated in chair 190 lifts a bin of bent spikes to the platform 198, using the hoist 200, and places another empty bin at the rear of the car to receive bent spikes being picked up. The operator then proceeds to straighten the bent spikes by manually lifting them from the hopper and placing them on the lower die 146 within the grooves 172, with the spikes being oriented so that the maximum bend is in the generally vertical direction. After a sufficient number of spikes are placed in the grooves 172, the operator actuates both control valves 180, 182 to drive the upper die downward with sufficient force from the ram 132 to substantially completely straighten all of the spikes within the grooves 172 in the vertical plane. Upon release of the valve control levers 184, 186, springs 152, 154 automatically returns the upper die 136 to its raised position, and any spikes needing straightening in another plane are rotated 90° in the grooves 172. The spikes not needing further straightening are manually removed and tossed into a bin 117 positioned beside the press on platform section 217, and additional bent spikes are positioned in any empty grooves 172. Valves 180, 182 are again actuated as described above to lower the upper die 136 to completely straighten the spikes left in the grooves 172 and to straighten the spikes newly placed in the remaining grooves 172 in one direction. Again, any spikes needing further straightening are rotated 90° and the remaining straight spikes removed and the procedure repeated until a bin of straight and/or straightened spikes are accumulated.

After sufficient straight and/or straightened spikes are accumulated, cover 106 is opened and a bin of straight and/or straightened spikes are lifted and dumped into the guide chute 105 where they fall, by gravity, into the interior of tumbler drum 30. Cover 106 is then closed and tumbler 28 is actuated to tumble the spikes for a sufficient time, usually within the range of six to ten minutes and preferably about eight minutes, to completely clean the spikes. During tumbling, the baffle plates 34 within drum 30 promote the tumbling and cleaning action, as does the octagonal configuration of the drum, by preventing the spikes from merely rolling or sliding around within the drum as it is rotated by the motor 38. During the tumbling operation, the top portion 84 of the housing front is maintained in the closed position. Also, during this tumbling operation, the operator can continue the straightening operation, and, of course, the collecting and sorting of the spikes along the roadway continues uninfluenced by any operation of the operator in chair 190.

When a bin of straight spikes have been completely tumbled clean, housing portion, or cover 84 is opened by actuation of ram 86 and with the drum 30 still rotating, ram 68 is actuated to lift the rear of the tumbler to discharge the cleaned completely reclaimed spikes through the front opening 76 onto the guide chute 78 where they fall, by gravity, into the empty spike keg or the like sitting on the bracket 80. These completely reclaimed spikes are then ready for use by the steel or tie renewal gang so that return to storage is not required. In this regard, car 10 is preferably provided with a fast road speed which, when necessary, can be utilized to deliver spikes to the steel or tie renewal gang working ahead of the reclaiming operation. Little time is, therefore, lost before the reclaiming car can be returned and picking up and sorting of the spikes can continue. Straightening and tumble cleaning of the spikes can continue regardless of the rate of movement of the car over the tracks or indeed without any car movement at all. Thus, the apparatus can be employed to reclaim spikes which are collected from other locations as well as along the immediate right of way, or the apparatus may be employed to reclaim spikes at a fixed location as in a work shop.

While preferred embodiments of the invention have been disclosed and described, it should be understood that the invention is not restricted solely thereto, but rather that it is intended to include all embodiments thereof which would be apparent to one skilled in the art and which come within the spirit and scope of the invention.

What is claimed is:

1. A method of reclaiming used railraod spikes pulled from cross-ties and discarded along a railroad right of way by utilizing two operators and a driven reclaiming car moveable over the railroad tracks and having a load support platform at its rear end, the car having mounted thereon a spike straightening press, a driven tumbler cleaner, a power hoist, and power means for operating the press, tumbler cleaner, and hoist and for driving the reclaiming car along the railroad tracks, the method comprising the steps of providing a plurality of portable spike receptacles on the reclaiming car platform in position to be accessible to a first operator walking along the right of way behind the car, driving the reclaiming car along the railroad tracks under control of the first operator, the first operator, manually picking up used spikes along the right of way and simultaneously sorting the used spikes to separate straight and bent spikes, the first operator, depositing the straight spikes in one spike receptacle on the reclaiming car platform and the bent spikes in another receptacle on the reclaiming car, the second operator riding on the car, moving the receptacles of spikes and empty receptacles with the hoist between the platform, press and tumble cleaner.

the second operator, operating the hoist to move a receptacle of spikes to be cleaned against a support adjacent an inlet chute into the tumble cleaner and then pivoting the receptacle about the support to discharge the spikes into the chute and then into the tumbler cleaner, and then actuating the tumbler cleaner to clean the spikes therein, while the tumbler cleaner is operating, the second operator manually placing bent spikes from the associated receptacle in the straightening press and operating the press to straighten the bent spikes therein, and after the conclusion of the tumble cleaning operation, the second operator, actuating the tumble cleaner to a tilted position causing the cleaned spikes to be discharged into a receptacle, and wherein the steps of straightening and cleaning spikes are performed at least in part while the reclaiming car is driven along the right of way and while the used spikes are being picked up and sorted.

2. The method of claim 1 wherein the step of sorting the used spikes includes segregating used spikes damaged beyond economical reclaiming, and collecting such damaged spikes as scrap in a third receptacle on the reclaiming car platform.

3. The method of claim 1 wherein said straightening press comprises upper and lower, relatively moveable die members, with the lower die member having a plurality of grooves formed in its top surface for receiving bent spikes, the grooves having substantially flat bottom surfaces and the depths of the grooves being less than the thickness of the spikes to be straightened, and wherein the step of straightening bent spikes on said press comprises manually placing the bent spikes in the grooves and thereafter actuating the press to move said dies relative to one another to clamp the bent spikes with sufficient force to straighten the spikes.

4. The method of claim 3 wherein the step of placing the bent spikes in the press comprises orienting the spikes with one flat surface of the spike being placed on the flat bottom surface of a groove in the bottom die and with the maximum bend in the spike being oriented toward the upper die.

5. The method of claim 4 wherein the step of straightening spikes in the spike press comprises the further steps of rotating through 90° any spikes in the press which were not completely straightened by the initial clamping step, and again clamping those spikes to thereby completely straighten the spikes.

6. The method of claim 5 wherein the step of tumble cleaning the straight and straightened spikes comprises tumbling the spikes in a horizontally oriented rotating tumbler drum for a period of at least about eight minutes.

* * * * *